United States Patent [19]

Klapperich

[11] Patent Number: 4,628,566

[45] Date of Patent: Dec. 16, 1986

[54] FILTERING SYSTEM FOR PAPER HANDLING MACHINES

[75] Inventor: Gary Klapperich, Dexter, Mich.

[73] Assignee: John C. Bertelsen, Dexter, Mich.

[21] Appl. No.: 798,447

[22] Filed: Nov. 15, 1985

Related U.S. Application Data

[63] Continuation-in-part of Ser. No. 632,897, Jul. 20, 1984, abandoned.

[51] Int. Cl.[4] ..... A47L 5/36

[52] U.S. Cl. ..... 15/300 A; 15/301; 15/314; 15/327 R; 15/331; 55/419

[58] Field of Search ..... 15/300 R, 300 A, 301, 15/314, 327 R, 331, 334, 347; 55/97, 316, 419, 498, 504

[56] References Cited

U.S. PATENT DOCUMENTS

| | | | |
|---|---|---|---|
| 2,625,703 | 1/1953 | Devau | 15/314 X |
| 3,030,650 | 4/1962 | Kiraly | 15/331 X |
| 3,240,000 | 3/1966 | Hayes | 15/314 X |
| 3,775,951 | 12/1973 | Eicholz et al. | 55/498 X |
| 3,785,129 | 1/1974 | Szmutko | 55/419 |
| 3,804,942 | 4/1974 | Kato et al. | 55/419 X |
| 4,563,943 | 1/1986 | Bertelsen | 55/419 X |

*Primary Examiner*—Chris K. Moore

*Attorney, Agent, or Firm*—Charles W. Chandler

[57] ABSTRACT

A filter apparatus is disclosed for removing contaminants discharged from paper handling machines in data processing rooms. Such contaminants include paper dust and carbon black from high speed paper handling machines such as computer printers, paper cutters and the like. The apparatus comprises a wheeled housing having a top cover with an outlet grille. A squirrel cage fan is suspended from the cover beneath the grille. A filter pack is mounted beneath the fan. The bottom of the housing has an inlet opening connected to a duct which passes air from the machine being serviced, through the filter pack and out the grille.

A vacuum motor is mounted in the bottom of the housing and connected to a flexible hose for picking up material on the floor as well as spillage from inside the data processing machines. This material is passed through an in-line hydraulic filter to remove large contaminants, and then through the filter pack to remove smaller contaminants.

9 Claims, 4 Drawing Figures

FILTERING SYSTEM FOR PAPER HANDLING MACHINES

CROSS-REFERENCE TO RELATED APPLICATIONS

This application is a continuation-in-part of my copending application Ser. No. 632,897, filed July 20, 1984, and now abandoned, for Vacuum Cleaner for Collecting Carbon Black.

BACKGROUND OF THE INVENTION

This invention is related to filtering devices for removing paper dust and computer chemicals such as developer, toner, carbon black and residues dispersed into the air in a data processing room by the operation of various paper handling machines, such as computer printers, and more particularly to a combination filter apparatus for removing computer room contaminants from the air passing into filter room from the paper handling machine, and for collecting floor contaminants such as carbon black.

SUMMARY OF THE INVENTION

Data processing rooms can be environmentally harmful to both the personnel and the equipment because of the material discharged in the air by high speed paper handling machines. Certain machines in computer rooms are very dirty. For example, it is often difficult to prevent the toner and developer from high speed laser printers from being discharged into the surrounding air when dry ink is inserted into the machine. The developer tends to collect on the computer room floor.

Laser printers develop a residue during the printing and "fusing" stages. They also create paper dust as do impact printers. Such machines frequently have inadequate internal filtering systems, and usually no facilities for disposing of toner and developer spillage. The problem is aggravated because the machines are usually in a closed, air conditioned room having a controlled environment.

Certain computer printer developers include fine iron filings. Machines having disk and tape drives and located in the same room must be taken off-line and internally cleaned because the abrasive carbon black and paper dust cause head crash and disk interference. This requires expensive service calls from the manufacturers' field engineers.

Some users employ a shop vacuum for collecting carbon black from the floor, however, the carbon black is so fine that it frequently passes through the filter bag, and so abrasive that it shortens the life of the vacuum machine seals and other components.

Locating a high speed printer away from the other equipment in the computer room is not the solution since toner and developer particles have been found to settle on computer screens located as far as 48 feet from the printer.

SUMMARY OF THE INVENTION

The broad purpose of the present invention is to provide an improved filtering system for closed, air conditioned computing rooms, adapted to remove a variety of contaminants from the room such as iron filings, paper dust, carbon black, toner and developer particles and other harmful chemicals by providing a filter apparatus suited for receiving the air discharged from the paper handling machine, and for picking up and collecting carbon black from the floor.

The preferred embodiment of the invention comprises a wheeled housing having a top opening. A removable cover having an outlet grille, is mounted on the top opening. A squirrel cage fan is suspended beneath the cover and is removable by the user with the cover without any tools for lubrication, inspection or cleaning. A multi-layer filter pack is mounted in the housing and includes four filtering stages for removing different types of particulates from the air.

The filter housing has a bottom opening for receiving a high volume of air from the printer. The air is passed upwardly through the filter pack for removing particles down to 5 microns in size.

The filter housing has a second bottom opening. A flexible hose provides a vacuum pick-up device for carbon black and other contaminants on the floor. The vacuum pick-up device passes the carbon black and air through a disposable, conventional oil filter for removing particles down to 25 microns in size. The air is then passed upward through the 4-stage filter which removes particles down to 5 microns in size. The double filtration of the floor particles provides special advantages for the user. The disposable oil filter processes a small volume of air for large particles. The partially filtered air is then mixed with the larger volume of air being cycled from the printer for removal of the smaller particles, that is, down to 5 microns in size.

A 5-micron oil filter, if used for the initial filtering of carbon black requires frequent replacement because it quickly becomes clogged with the finer particles.

The commercial embodiment of the invention is used by major universities, insurance companies, banks and other major computer users because it is the only product commercially available for removing contaminants unique to a computer installation.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
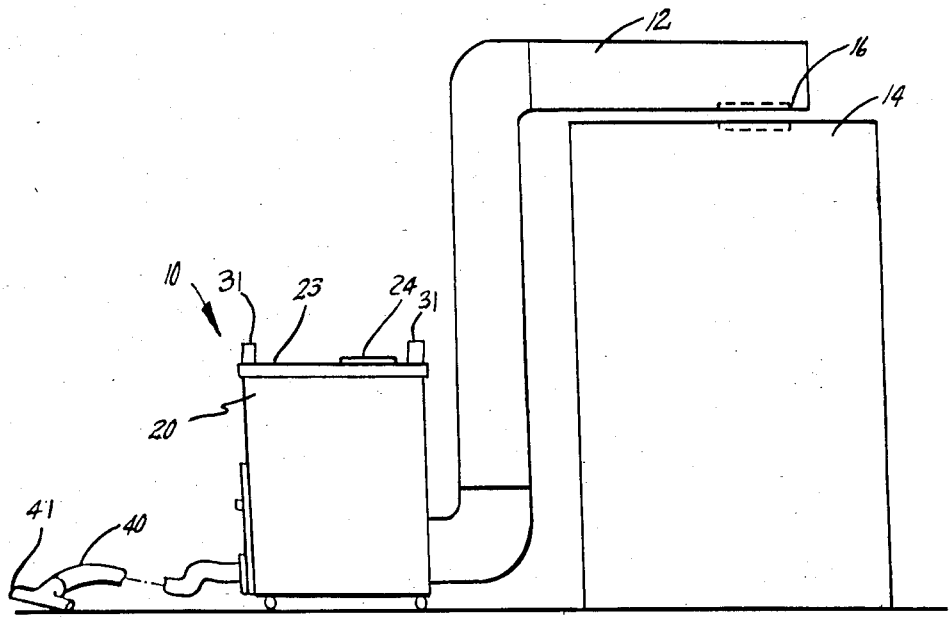
FIG. 1 is an elevational view of filtering apparatus illustrating the preferred embodiment of the invention mounted adjacent a laser printer.

Referring to the drawings, FIG. 1 illustrates a preferred mobile filtering apparatus, generally indicated at 10, having hood 12 and duct 13 for removing contaminants discharged from conventional high speed laser printer 14. The hood is custom designed to accommodate the outlet air opening of the particular computer device being serviced.

The hood has inlet opening 16 for receiving the contaminants and directing them toward bottom opening 18 of filter housing 20.

Figure 2:
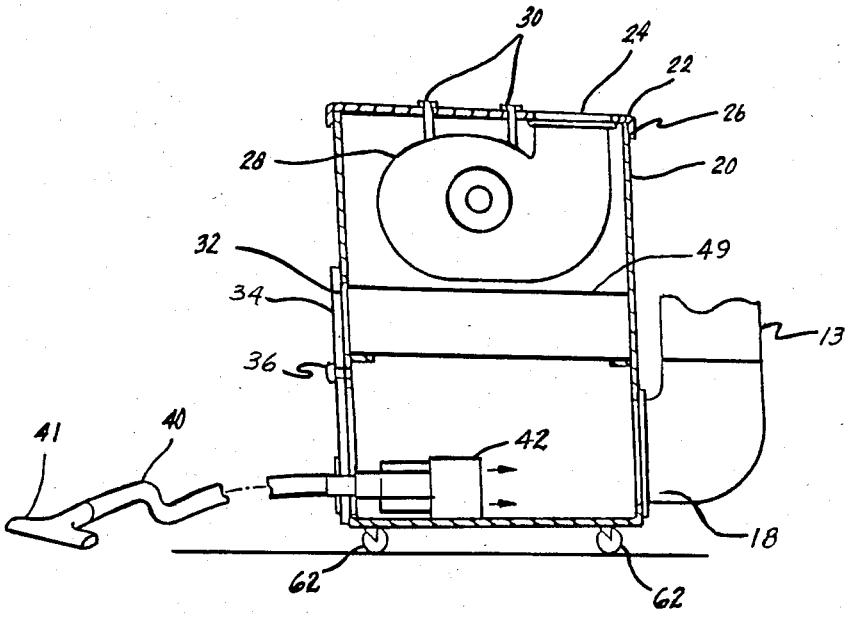
FIG. 2 is a sectional view through the filter housing of FIG. 1.

Referring to FIG. 2, housing 20 has a top opening 22. Cover 23, having grille 24, is mounted on the top opening, and has a downwardly depending lip 26 around the top edge of the housing.

An electrically-energized squirrel cage fan 28 is suspended by four bolt means 30 beneath the grille so that the cover and the fan can be lifted together by a pair of handle means 31 from the filter housing for lubrication and service.

Housing 20 also has front opening 32 for receiving a filter pack. Cover 34 is attached by fastener means 36 over opening 32.

Fitting 38 is mounted on the housing and adapted to support one end of flexible hose 40. Pick-up nozzle 41 is mounted on the outer end of the hose for picking up carbon black from the floor of the computer room. Other types of nozzles can be mounted on the flexible hose.

Figure 3:
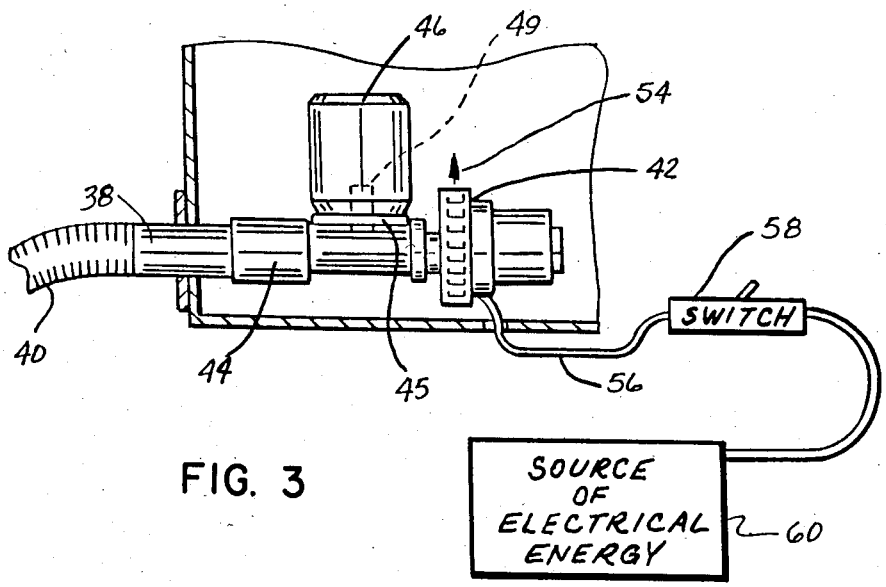
FIG. 3 is a fragmentary, partially schematic plan view of the vacuum pick-up apparatus.
Figure 4:
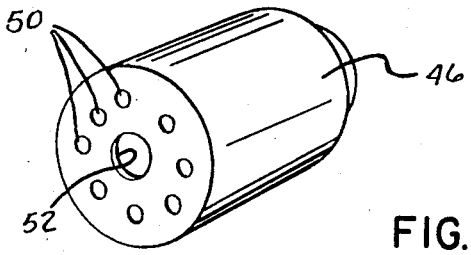
FIG. 4 is a view of the hydraulic oil filter cartridge employed in FIG. 3.

Referring to FIG. 3, conduit 44 is mounted in the housing to receive air passing through hose 40. Vacuum motor means 42 are mounted on the inner end of the conduit for producing an air flow through hose 40 and conduit 44. A circular mounting plate 45 is carried by conduit 44.

Hydraulic oil filter cartridge 46 is mounted on a threaded nipple 48 carried by plate 45. Preferably, cartridge 46 is a conventional oil cartridge used in hydraulic systems such as Model AF-10, provided by Zinga Industries, Inc., of Elk Grove, Ill. The cartridge has a predetermined filtering capability determined in terms of the size of the material that can be removed through the fluid passing through the cartridge. Preferably the cartridge has a 25-micron filtering capacity. Smaller material is removed by multi-filter unit 49 in housing 10.

The air received through hose 40 passes through an annular array of openings 50 into the filter cartridge, through the filtering material contained in the cartridge and then out through threaded central opening 52. The filtered air then is delivered through the balance of conduit 44, where it is then passed through vacuum motor housing 42 in the direction of arrow 54. The vacuum motor has an electrical cord 56 connected by an on-off switch 58 to a source of electrical power 60.

The contaminants are then directed upwardly toward the grille opening through filter pack 49. The 4-stage filter pack includes a 1 inch thick element of a nonwoven cotton fiber, a 4 inch thick element of an ultra-fine fiberglass, a double stage unit having particles of activated charcoal for removing odors and a synthetic product known as "PURAFIL" to detoxify substances such as formaldehyde.

The housing is mounted on wheel means 62 so that the user can move the filter housing toward a selected location.

Thus, it is to be understood that I have described an improved filter housing for computer rooms in which the filter apparatus has means for removing contaminants passed from a paper handling machine, such as a computer printer, and a vacuum cleaner attachment for removing contaminants from the floor as well as inside an apparatus.

Having described my invention, I claim:

1. A combination filter means for removing paper dust, carbon black and the like from a computer room, comprising:

a housing having a discharge opening, a first inlet opening, and a second inlet opening;

an electrically energized squirrel cage fan, and means mounting the fan in the housing for moving air from the first inlet opening to the discharge opening;

filter pack means for removing materials from air being passed therethrough, the filter pack being mounted between the discharge opening and the first inlet opening for removal of material of a lesser size;

vacuum means mounted in the housing to provide an air flow through the second inlet opening, independent of air flowing through the first inlet opening;

a filter cartridge adapted to filter hydraulic fluids, the filter cartridge having an inlet for receiving unfiltered hydraulic fluid, and an outlet for removal of filtered hydraulic fluid, and filter means disposed between the inlet and the outlet for removal of material of a greater size;

means for introducing air from the second housing inlet through the filter cartridge inlet for removal of material of said greater size, and for directing filtered air from the filter cartridge outlet toward the filter pack so as to be refiltered to remove material of said lesser size.

2. A combination as defined in claim 1, in which the filtered air from the filter cartridge outlet is mixed in the housing with air being received into the housing through the first inlet opening.

3. A combination as defined in claim 1, in which the filter cartridge is adapted to remove material down to 25 microns in size, and the filter pack is adapted to remove material down to 5 microns in size.

4. A combination as defined in claim 1, in which the filter pack is a multi-stage filter including a nonwoven cotton fiber, an ultra-fine fiberglass, an activated charcoal for removal of odors and a material for detoxifying substances such as formaldehyde.

5. A combination as defined in claim 1, in which air is passed through the filter cartridge at a lesser volumetric flow, and air is received through the first inlet at a greater volumetric flow, the filtered air from the filter cartridge and the air received into the housing from the first inlet opening are mixed together and the mixture is passed through the filter pack.

6. A combination as defined in claim 1, in which the housing has a top discharge opening and a lower first inlet opening, and including a cover having a grille for passing filtered air from the housing, the cover being removeably mounted in said top opening, and including elongated fastener means having their upper ends connected to the cover and their lower ends connected to the fan such that the fan is suspended solely from the cover when the cover is mounted on said top opening, the fan being removeable through the top opening at such times as the cover is being removed from the housing.

7. A combination as defined in claim 1, in which the vacuum means includes a vacuum motor mounted in the housing for providing air flow through the filter cartridge.

8. A combination as defined in claim 1, in which the means for introducing unfiltered air into the filter cartridge includes a flexible conduit means having a nozzle adapted to pick up carbon black and the like.

9. A combination as defined in claim 1, in which the filter cartridge is removeable from the housing for replacement by another filter cartridge.

* * * * *